United States Patent [19]

Anderson

[11] 4,436,451

[45] Mar. 13, 1984

[54] SELF-STANDING MARINE RISER

[76] Inventor: Harold E. Anderson, 26 Dover St., London, England, W1X 3PA

[21] Appl. No.: 264,867

[22] Filed: May 18, 1981

[30] Foreign Application Priority Data

Feb. 20, 1980 [GB] United Kingdom ..... 8005655

[51] Int. Cl.[3] ..... E21B 7/12

[52] U.S. Cl. ..... 405/195; 166/355

[58] Field of Search ..... 405/195, 202, 224; 166/354, 355, 349, 352, 367; 175/7, 8

[56] References Cited

U.S. PATENT DOCUMENTS

| | | | |
|---|---|---|---|
| 2,512,783 | 6/1950 | Tucker | 175/8 X |
| 3,086,368 | 4/1963 | Popper | 405/224 |
| 3,142,343 | 7/1964 | Otteman et al. | 166/355 X |
| 3,481,294 | 12/1969 | Vincent | 175/7 X |
| 3,493,043 | 2/1970 | Watkins | 166/352 X |
| 3,513,911 | 5/1970 | Petersen | 166/349 X |
| 3,601,075 | 8/1971 | Deslierres | 175/7 X |
| 3,601,187 | 8/1971 | Tidwell | 175/7 X |
| 3,760,875 | 9/1973 | Busking | 166/355 X |
| 3,791,442 | 2/1974 | Watkins | 166/352 |
| 3,981,357 | 9/1976 | Walker et al. | 405/195 X |
| 3,992,889 | 11/1976 | Watkins et al. | 405/195 |
| 4,155,673 | 5/1979 | Yashima | 405/224 |
| 4,231,429 | 11/1980 | Kolpak | 175/7 X |
| 4,281,614 | 8/1981 | McNary et al. | 175/7 X |
| 4,284,367 | 8/1981 | Tuson et al. | 405/202 |
| 4,335,979 | 6/1982 | Stafford | 405/202 |
| 4,388,022 | 6/1983 | Gentry et al. | 405/195 |
| 4,391,332 | 7/1983 | Fayren | 166/367 X |

*Primary Examiner*—Ernest R. Purser

*Attorney, Agent, or Firm*—Finnegan, Henderson, Farabow, Garrett & Dunner

[57] ABSTRACT

A self standing marine riser is provided which comprises a base, a riser column, a flexible joint between the base and the riser column, and means for providing a loose coupling between the top of the riser column and a vessel, rig or platform on the surface above the location of the riser. The riser column comprises an upper column section which includes at least one buoyancy chamber, and a lower, relatively slender column section. The riser includes, or is adapted to support, at least one conduit for the conveyance of a fluid (e.g. oil or gas) or a control line. The buoyancy provided by the upper section of the riser column is preferably variable, and this facilitates the connection and use of the riser. The riser may be used for drilling operations or for production operations. By employing a riser in accordance with the invention, it is not necessary to use large riser tensions in order to maintain the position and structural integrity of the riser in deep water and rough weather.

14 Claims, 6 Drawing Figures

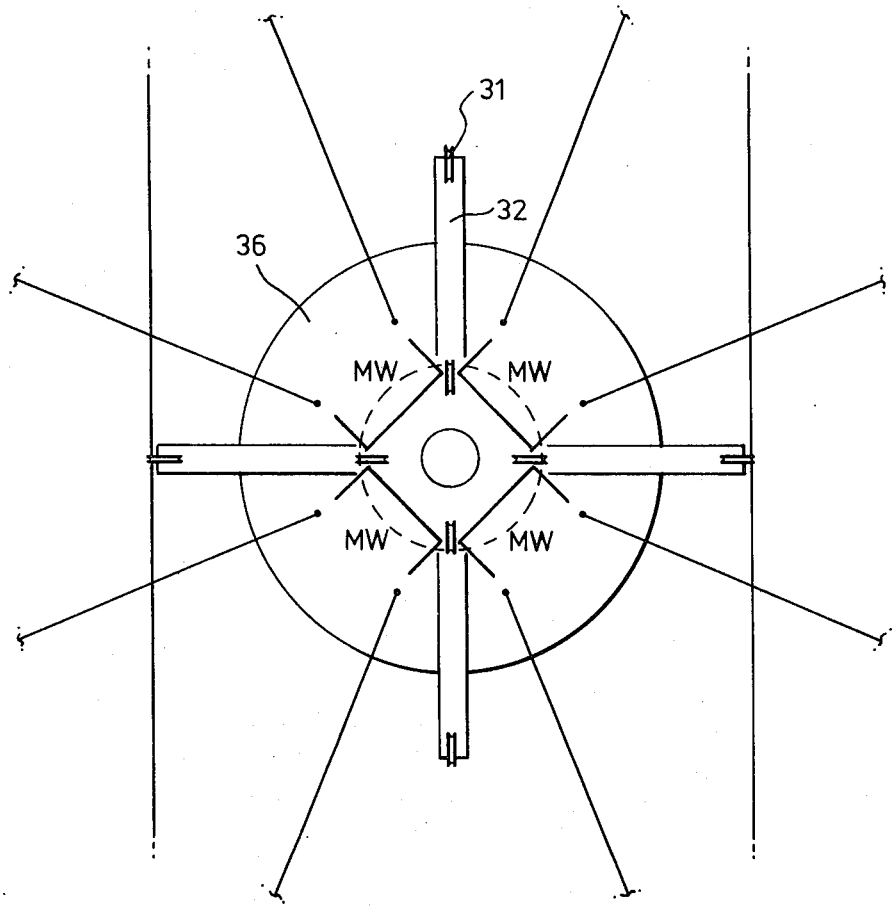
Fig. 5.
Fig. 6.
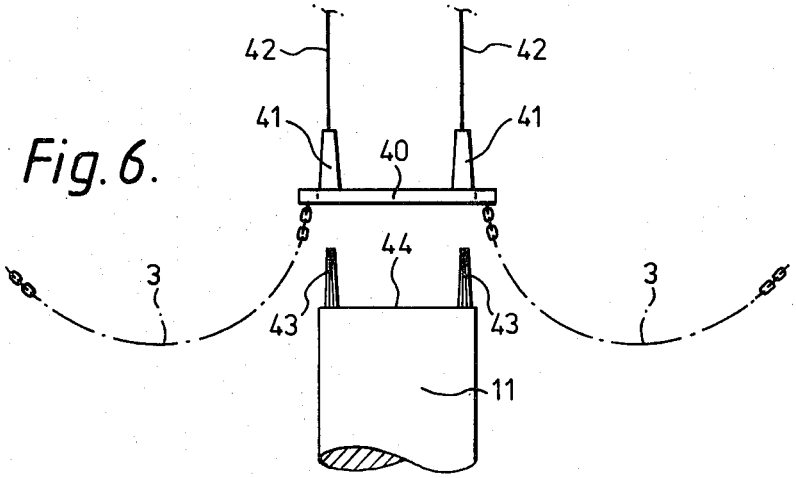

SELF-STANDING MARINE RISER

BACKGROUND OF THE INVENTION

This invention relates to a self-standing marine riser suitable for use in drilling, and in semi-submersible production operations and with a dynamically positioned oil/gas production ship, a chain moored ship with a spindle or with a tension leg platform.

SUMMARY OF THE INVENTION

According to the present invention, there is provided a self-standing marine riser which comprises a base, a riser column, a flexible joint between the base and the riser column, and means for providing a loose coupling between the top of the riser column and a vessel, rig or platform on the surface above the location of the riser, characterised in that (1) the riser column comprises a lower, relatively slender column section and an upper column section which includes at least one buoyancy chamber, and (2) the riser includes, or is adapted to support, at least one conduit for the conveyance of a fluid. The fluid can be oil, gas, water, or drilling mud. Optionally there may be provided a conduit for conveying solid objects, such as tools, from the top of the riser to the base. One or more control lines (e.g. electrical or hydraulic lines) may be housed in the or one of the conduits. A flexible joint may be provided at the top of the riser column between the column itself and a riser bundle connecting with the surface structure and through which the conduit for the conveyance of a fluid passes.

DESCRIPTION OF THE PREFERRED EMBODIMENTS

It is preferred that the buoyancy provided by the upper column section should be variable. This arrangement facilitates the emplacement of the riser and its loose coupling to a surface vessel or structure. The buoyancy chamber(s) are advantageously such as to enable neutral buoyancy to be achieved; in preferred embodiments of the invention, positive and/or neutral buoyancy can be achieved for the riser alone, submerged and unattached to the surface vessel, or for the combination of the riser and the means by which it is loose coupled to the surface vessel or structure, or when coupled to the surface vessel or structure. This loose coupling is advantageously effected by chains which are removably attached to the top of the riser column. Conveniently there can be four such chains when the riser is secured to a semisubmersible rig or platform. If the riser is secured to a ship, there may be two or four such chains attached to a swivelling ring to allow for azimuth variations.

The riser can include one or more pipes attached to the exterior of the riser column at least in the region of the lower section thereof. One or more flexible hoses may be provided at the lower end of the riser to connect the or each of said pipes to a wellhead or a production outlet at, or in the vicinity of, the base of the riser.

The base itself can be a gravity base or a piled base. Generally, the base will be aligned next to or positioned around a sea bottom drilling template. If the base is a piled base, it is preferable to install the base at the same time as the drilling production template, for reasons of wellhead safety. The riser column and flexible joint may then be linked to the base with a connector on completion of the well drilling.

The riser is self-standing and buoyant when standing alone and submerged. Two or more wirelines are preferably attached between the upper column section and the base. These initially are used as guideline wires to emplace the riser and connect it to the base; subsequently when terminated and fastened to the upper section of the riser after its emplacement and attachment to intermediary points and to the base they act as safety wires to avoid accident should the riser break, serving to prevent the riser accelerating to the sea surface. The necessary slack in the wires to allow freedom of riser column angular movement is advantageously taken up by weighted lever devices at the base. In preferred embodiments the riser is chained by four chains to a semi-submersible structure through pontoon mounted fairleads or to a ship either through spaced hull-mounted fairleads (when the ship is dynamically positioned over the riser) or in the case of a spindle-moored ship through fairleads which form part of the spindle structure. Each chain may be connected to the riser via a swivel chain fastener or fasteners that are part of a swivelling ring located about the riser top. The first arrangement is preferred for connection to semisubmersibles and to spindle-moored vessels while the second is preferable for connection to ship-shaped surface structures which are dynamically positioned and must weathervane. Preferably, the chains can be "quick released" from the riser, the action necessary to achieve this being effected on the semi-submersible platform or on the vessel to which the riser is loose coupled.

The conduits for conveying fluids, e.g. oil or gas, along the riser can terminate in a submerged riser top manifold/stabbing block. The connection between the manifold/stabbing block and the production facility should be of the quick-release type, so that in an emergency the well(s) may be shut-in, after which the connection to the riser conduit(s) may be "quick-released" from the top of the submerged riser, followed by "quick release" of the chains from the submerged riser top. The connection from the surface vessel to the riser manifold/stabbing block can be in the form of a flexible riser bundle. When the self-standing riser is emplaced, it will generally be fully submerged. With an arrangement such as that just described, the tensioned riser bundle will be supported by tensioners which compensate for vessel motion, draught and changes in sea level.

With the preferred structure described above, if the self-standing production riser should break loose while still connected to a semi-submersible or vessel production facility, the riser will not float to the surface because of the restraining safety wires and the weight imposed by the catenary chains.

In general, the riser will maintain a substantially upright configuration. Movement of the vessel, rig or platform to which it is loose coupled as well as tidal and current effects may result in the riser moving away from the vertical. The riser will accommodate a maximum of 15° tilt from the vertical, but it is preferred that the riser should not deviate from the vertical by more than 10°. Under normal operating conditions, the maximum inclination of the riser is expected to be about 7° or less from the vertical.

A riser constructed in accordance with the present invention does not require a complicated tensioning system to hold it in place. The buoyancy and stiffness provided in the submerged riser mean that the riser is not subjected to stresses as severe as those normally associated with an equivalent length tensioned riser. Furthermore, the design is such that if the riser breaks free at the bottom while connected to a production facility, it will not inevitably come to the surface and/or collide with the production facility. Also, if a piled or gravity base is employed, it can straddle the well head template (without contacting it) thereby providing protection for the well "trees".

BRIEF DESCRIPTION OF THE DRAWINGS

For a better understanding of the invention, and to show how the same may be carried into effect, reference will now be made, by way of example, to the accompanying drawings, in which:

FIG. 5 is a schematic plan view of the arrangement shown in FIG. 4; and

FIG. 6 illustrates one method of connecting a surface structure and the marine riser.

Figure 1:
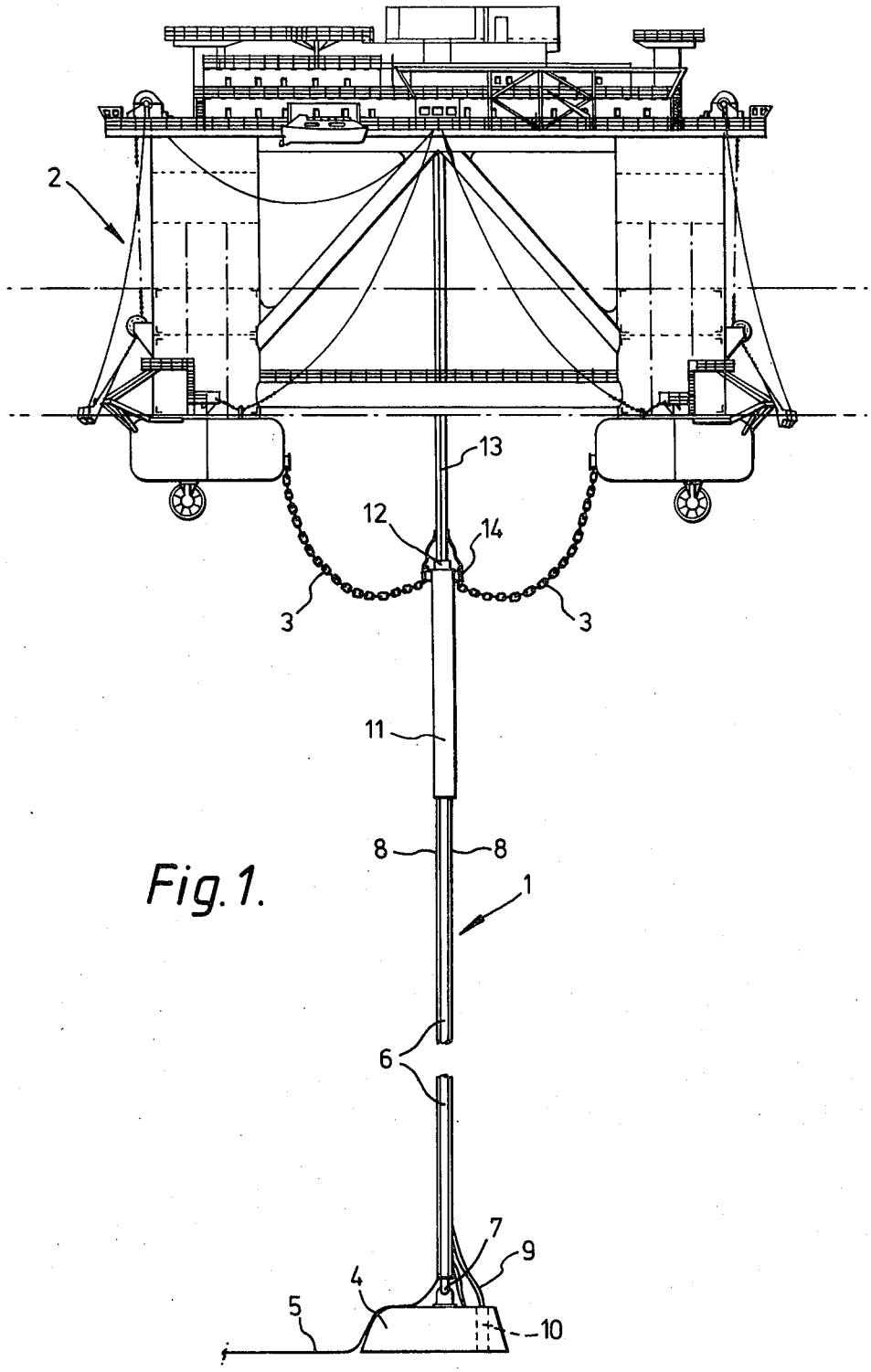
FIG. 1 shows a front view of a self-standing production riser in accordance with the invention loosely coupled to a semi-submersible production platform.
Figure 2:
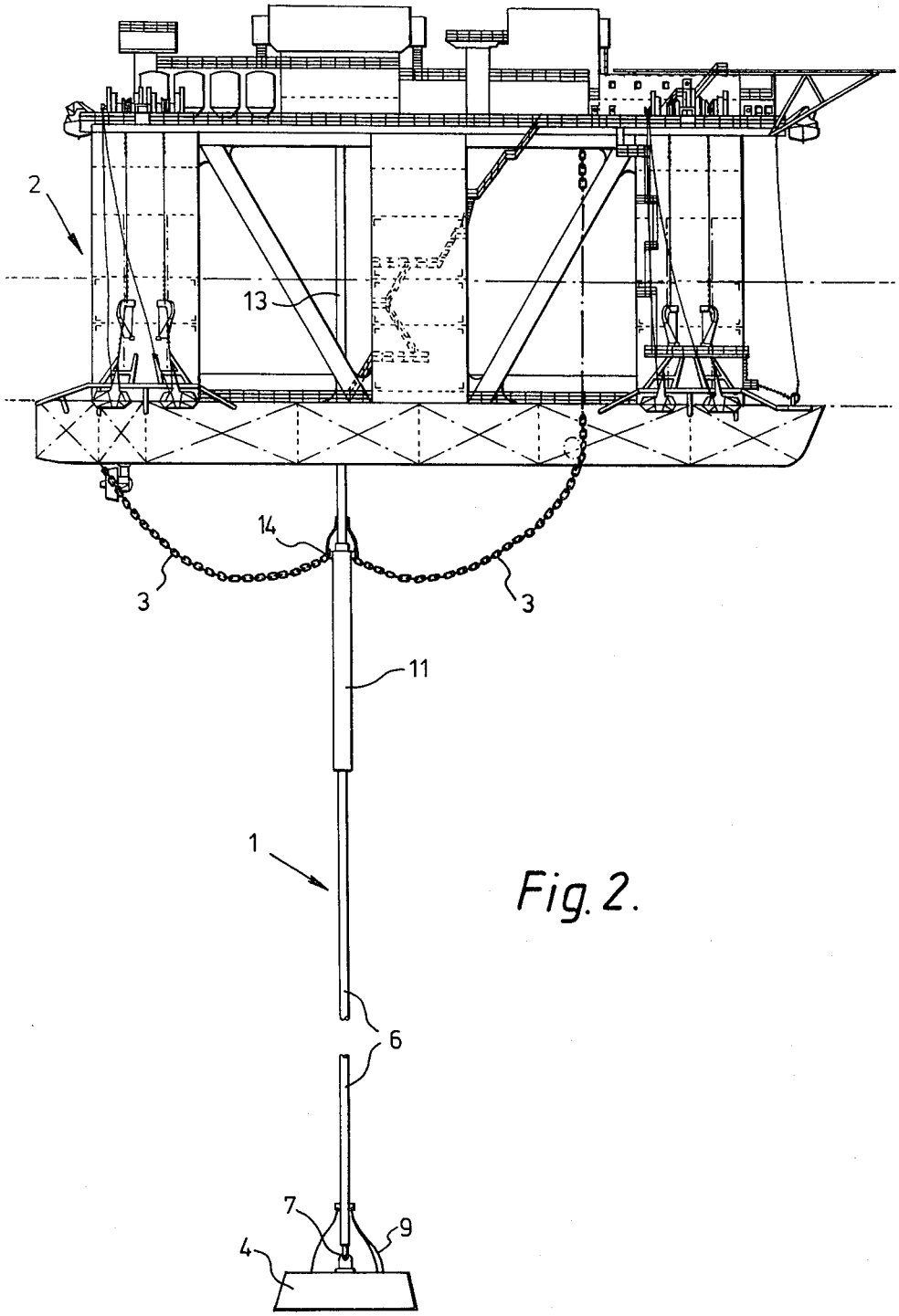
FIG. 2 shows a side view of the apparatus of FIG. 1.

Referring now to the drawings, the riser 1 shown in FIGS. 1 and 2 is loosely coupled to a semi-submersible production platform 2 via a plurality of chains 3. There are four such chains in the embodiment illustrated in the drawings. As illustrated, the chains are attached to the inboard area of the pontoon; alternatively they may be attached to the outboard area. The riser 1 comprises a piled or gravity base 4, e.g. a piled steel base which can have two basic configurations. In the first, it is mounted over but is not in contact with a circular wellhead template (not shown). In the second, the base is connected to one end or to the middle of a rectangular or square wellhead template. The circular template can accommodate ten wells with one spare slot in its presently envisaged form. The number of wells which can be accommodated depends on the capability of the riser and manifold system to handle the fluids. In the circular wellhead template, the production trees are protected by the base 4. The riser may also be connected to a satellite production tree or trees or a separate manifold well template adjacent the base 4, as indicated by line 5 in FIG. 1.

The riser column comprises a lower slender part 6 connected to the base 4 by a universal, ball or flex joint 7. Pipe conduits 8 are mounted on the outside of lower section 6 of the riser column. Each of conduits 8 is connected at its lower end to a flexible hose 9 which in turn is connected to the well production tree 10. The lower part 6 of the riser column occupies the greater proportion of the total length of the riser. The upper portion 11 of the riser column includes both a fixed and a variable buoyancy system. Conduits 8 pass through the interior of upper riser column section 11.

At the top of the riser column, there is a riser top manifold/stabbing block 12 by means of which a flexible riser bundle 13 may be connected to the upper termination of conduits 8.

The length of each of chains 3 is adjustable. Under normal operating conditions, each chain will generally have substantially the same length. The connection between the chains 3 and riser 1 is effected at swivelling chain fasteners 14 which are attached to the outside of upper riser column section 11 at the top part thereof. The length of each chain catenary between connectors 14 and the pontoon fairleads of the production platform 2 will normally be in the range from 20 to 60 meters, preferably about 45 meters; the length may occasionally be as little as 10 meters. The loose chain connections may be made either to the insides or to the outsides of the pontoons, and the chain will generally run through fairleads whose positions are such as to afford the optimum scope ratio for control of the submerged riser. The scope ratio will depend on environmental conditions, rig layout, depth of the riser top below sea level and pontoon depth for an optimum operation.

Figure 3:
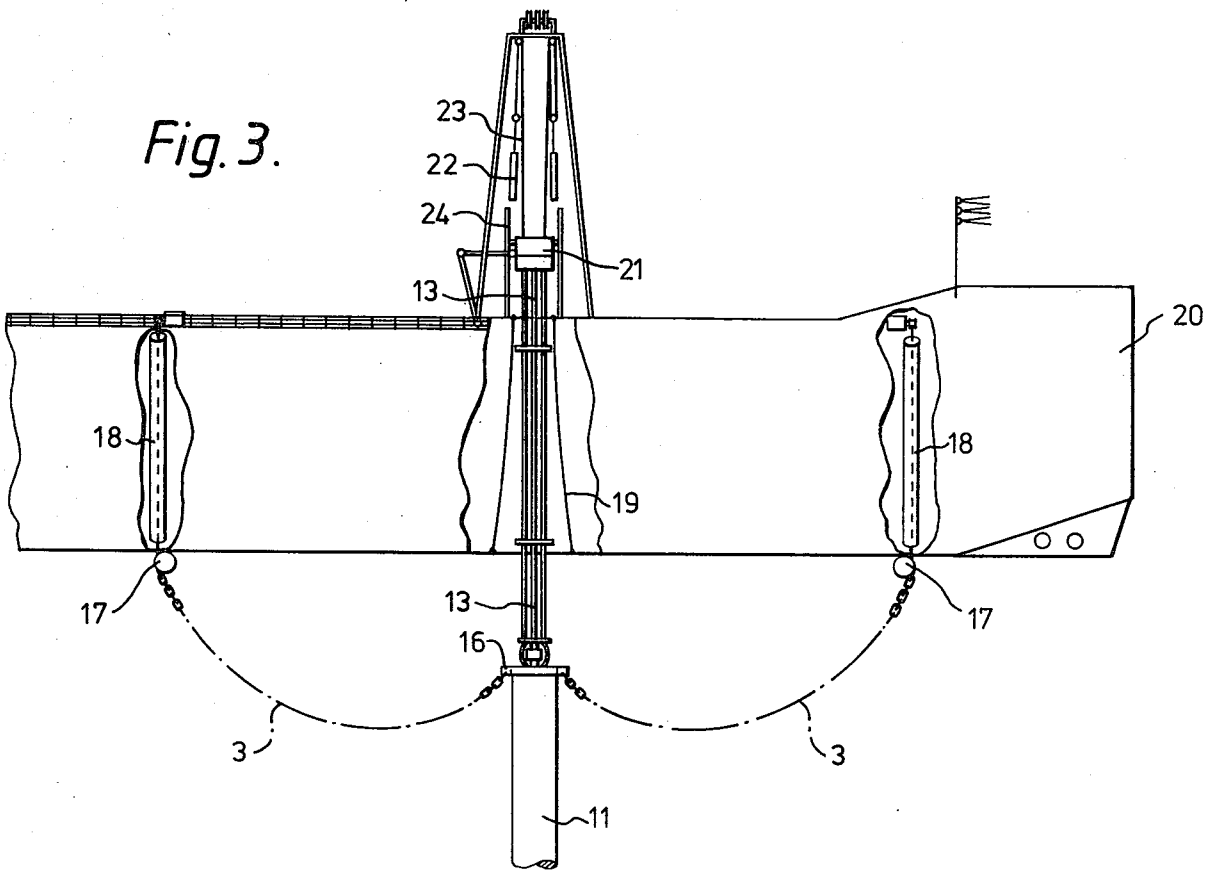
FIG. 3 shows a front view of the top of a self-standing production riser in accordance with the invention loosely coupled to a production/storage ship-shaped vessel.

Referring now to FIG. 3, there is shown a mooring arrangement suitable for use when a self-standing production riser in accordance with the present invention is loosely coupled to a dynamically-assisted vessel, i.e. a ship or barge whose mooring position is maintained with dynamic assistance. The two chains 3 are attached to the upper section 11 of the riser column at a slewing ring 16 which is fitted about the top part of column section 11. The chains 3 pass over chain sheaves 17 which preferably can be raised or lowered by a predetermined amount in order to adjust the vertical/horizontal chain catenary ratio to the optimum for any given circumstance. The mooring chains then pass upwardly into chain tubes 18 within the vessel 20. Alternatively, if four chains 3 are employed, there may be four chain tubes 18 positioned on the outside of the hull of the vessel. The flexible riser bundle 13 passes through a moonpool 19 and terminates at a fluid swivel 21 to which tensioners 22 are connected via cables 23. A guide frame 24 holds fluid swivel 21 in position in a horizontal plane, and also functions to rotate it.

Figure 4:
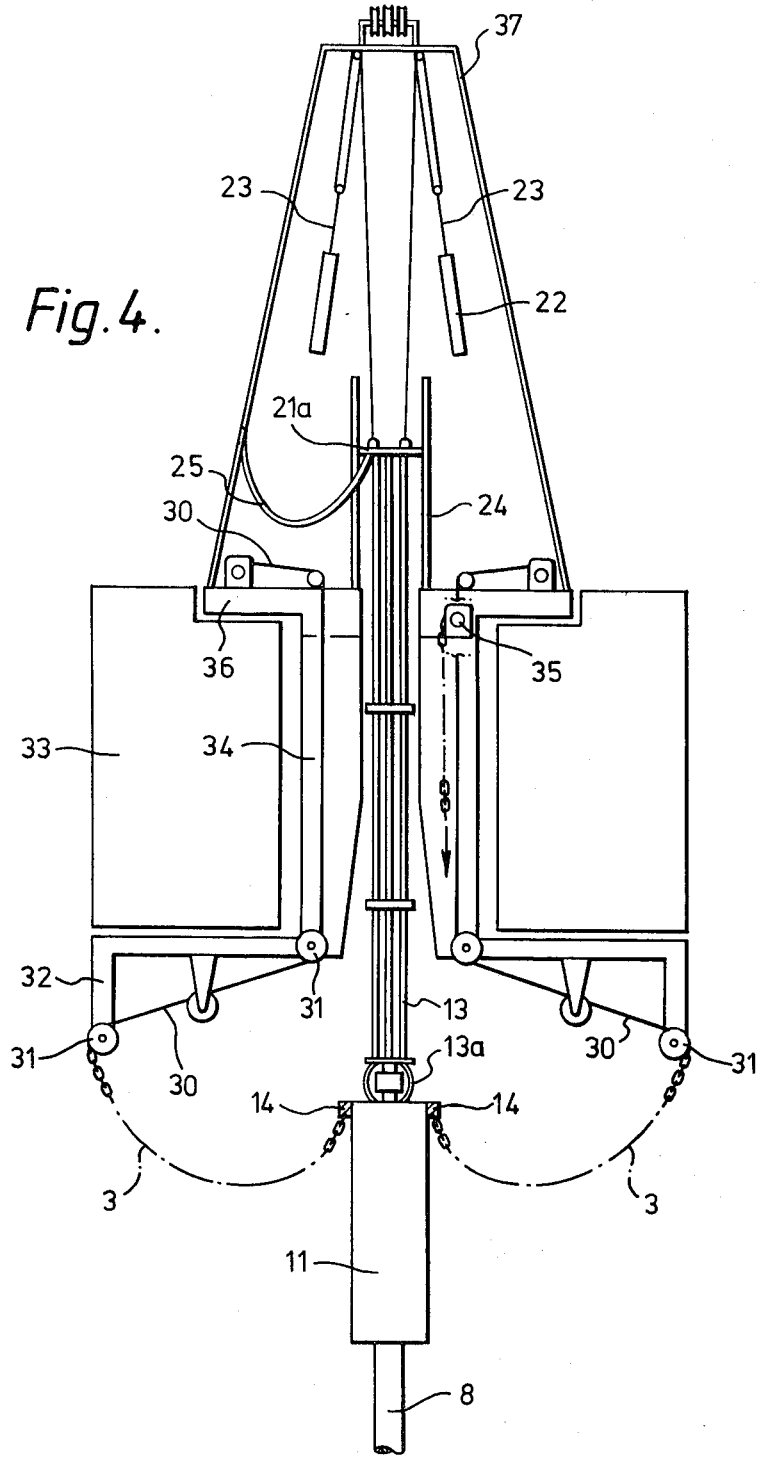
FIG. 4 shows a front view of the top of riser in accordance with the invention loosely coupled to a dynamically assisted ship or barge having a turret/chain mooring arrangement.

Referring now to FIGS. 4 and 5, an arrangement is shown for connecting a free-standing marine riser in accordance with this invention to a vessel having a turret/chain mooring arrangement. In this case, the mooring chain 3 can be connected to the top of riser section 11 either by two, three or four swivelling chain fasteners or by chain fasteners which are part of a slewing ring attached to the outside of upper riser section 11. The arrangement illustrated in FIG. 4 shows the first of these two possibilities, there being two swivelling chain fasteners 14 attached to the outside of upper riser column section 11. The choice between these two possible configurations will be decided according to the method of equipment installation relative to acceptable weather conditions. The outboard ends of mooring chains 3 are connected to wires 30 which pass over fairleads 31 held by spreader arms 32. The length of each chain catenary between fasteners 14 and the first of the fairleads 31 will generally be about 23 to 27 meters in the presently preferred arrangement. The spreader arms 32 are structurally connected to a cylindrical body 34 forming part of the vessel 33, the interior of body 34 constituting a spindle or turret. This turret also houses winches and mooring line equipment (not shown) and anchoring windlasses one of which is shown at 35. When the mooring lines are in place, the turret 34 remains on a consistent heading while the vessel itself can weathervane about the turret.

The flexible riser bundle 13 passes through turret 34 and terminates at a multi-fluids swivel 21*a* mounted above the vessel deck. This swivel is held in a gimballing table guided by frame 24 attached to riser tensioning wires 23 which terminate in tensioning means, such as pneumatic or hydraulic tensioners or weights 22.

The schematic arrangement shown in FIG. 5 illustrates the positioning of four double-drum mooring winches or windlasses (MW) mounted on top of turntable 36 which is, in effect, the topmost part of turret body 34.

The riser 1 can be used in deep water conditions, for example at depths of 90 meters (300 feet) or greater.

An emergency release system (not shown) is provided to enable chains 3 to be separated from riser 1 quickly. The system can comprise a wire attached to a locking arm which, when the wire is pulled taut, will cause a locking pin holding a respective chain to connector 14 to shear and allow the chain to fall free of the riser.

The loose coupling between riser 1 and platform shown in FIGS. 1 and 2 may be effected as follows. Initially, the buoyancy of the riser is adjusted so that it is slightly positive. With the riser in this condition, the semisubmersible is moored with its moonpool centered over the riser. When all is ready for effecting the connection, the buoyancy in upper section 11 of the riser column is increased and the chains 3 are lowered from the semisubmersible for connection to the top of riser 1. This can be done by attaching strayline wires to a point a given number of links above the hanging chain ends, and paying out the chains as the wires are pulled towards the moonpool. The end links or shackles of the chains will be locked into the riser swivelling chain fasteners 14, opposing chains preferably being connected simultaneously. The strayline wires may then be let out and detached from the chain; they can later be used as guidelines for guiding the riser sections from the surface to the stabbing manifold block at the top of the submerged riser. Next, the chains will be tightened to give the desired catenary chain lengths. When the first two chains are connected, the procedure will then be repeated for the other two opposing chains. When all four chains are connected, the combined weight of the coupled chains, the riser and the maximum vertical wave force is buoyed, which results in an overall marginally positive buoyant system.

The loose coupling between riser 1 and the vessel 20 shown in FIG. 3 may be effected as follows. The vessel 20 is positioned with its moonpool centered over the riser 1. When all is ready for effecting the connection, the buoyancy in the upper section 11 of the riser column is increased and the chains 3 are lowered from the sides of the vessel through bilge-mounted fairleads for connection to the top of the riser. The procedure for effecting this connection may be substantially the same as that described above with reference to FIGS. 1 and 2. However, instead of attaching the chains to swivelling chain fasteners 14, they are attached to connectors mounted on the slewing ring 16 which is capable of rotation about the top of riser section 11.

The coupling between riser 1 and the turret/chain moored vessel shown in FIGS. 4 and 5 may be effected generally as described above with reference to FIGS. 1 and 2. The flexible riser bundle 13 is connected to the submerged riser section 11 at a stabbing block manifold show diagrammatically at 13*a* in FIG. 4. Sections of the flexible riser bundle 13 pass through the turret 34 to the deck area of the vessel, where a multi-fluid swivel 21*a* is provided. The top section of swivel 21*a* is affixed to a gimballed plate forming part of the frame 24 and having wire connections 23 to tensioning means e.g. weights 22 which are suspended via pulleys from a supporting frame 37. This frame is also used to pull and lower the riser sections as required. Hard piping or hose 25 having terminal swivel joints are connected to the multifluid swivel 21*a*, there being a separate piping line for each fluid which is carried in the system. The hard piping is arranged so as to allow the heave of the vessel to be accommodated. The pitch and roll of the vessel, and the angular offset of the riser sections caused by vessel movement, is accommodated by the gimballed plate which forms part of the frame 24. Where line 25 is in the form of hard piping, it may advantageously be guided by a sleeve-like structure for support (such as that shown in FIG. 3), since a certain amount of torque at the multi-fluid swivel will develop with change of vessel heading. To protect the riser sections from torque build-up, pressure sensing transducers may be employed in conjunction with fluid swivel turning motors mounted on the multi-fluid swivel 21*a;* these are not shown in the drawings.

An alternative method of attaching the mooring chains 3 to the top of the submerged buoyant riser will now be described with reference to FIG. 6. In this figure, four chains 3 are attached to a circular plate 40 which is provided with three or four tapered sockets 41. The plate 40 is suspended by wires 42 (conveniently the same in number as sockets 41) which wires may be passed through a vessel chain tube or turret as shown in FIGS. 1 to 5. The top of the riser section 11 is formed with an appropriate number of upstanding, fluted posts 43 which are designed to mate with the sockets 41. The posts 43 may be mounted on a slewing ring (not shown in FIG. 6). As plate 40 is lowered, the fluted posts 43 penetrate into sockets 41 from which water is forced out. This evacuation of water from within the sockets 41 causes an automatic cushioning effect which increases in magnitude as the plate 40 approaches surface 44 of riser section 11. This passive cushioning effect assists the steady location of the plate 40 onto the riser section 11. When the fluted posts 43 are fully engaged in sockets 41, plate 40 may be locked hydraulically to the top of the submerged riser.

After connection in the manner just described, the riser bundle with its centering probe and a hydraulic connector, flexible joint and riser flowline tubes, is lowered and positioned, locked and tensioned, for example by use of the riser tensioners 22 as illustrated in FIGS. 3 and 4. Buoyancy in the submerged riser section 11 is adjusted when the riser bundle is connected thereto.

A modified arrangement may be adopted at the lower end of the submerged riser in order to facilitate well entry through the top of the well tree(s). In this modification, a circular well template is provided inside the riser base and the flowlines connected from each tree pass up along a bell-shaped, gimballed structure attached to the lower riser section at a point high up enough to allow as slight an angle of flowline deviation as possible; the gimballed structure is also attached low enough on the riser so as not, with changing riser angles, to cause too much deflection of the flowlines. A flex joint will be provided atop each well tree in order to accommodate the changing flowline angles caused by movement of the bell-shaped structure as it follows the riser deflections.

What is claimed is:

1. A self-standing marine riser which comprises a base, a riser column, a flexible joint between the base and the riser column, and a plurality of catenary chains attached to the top of the riser column for providing a loose coupling between the top of the riser column and a surface structure including a vessel, rig, platform and the like on the surface above the location of the riser, said chains providing a direct connection between said riser column and said surface structure, said riser column comprising a lower relatively slender column section and an upper column section which includes at least one variable buoyancy chamber, said riser supporting at least one conduit for the conveyance of a fluid.

2. A riser as claimed in claim 1, said buoyancy chamber being adapted to achieve neutral buoyancy for the riser.

3. A riser as claimed in claim 1, said chains being removably attached to the top of the riser column.

4. A riser as claimed in claim 3, wherein the chains are attached to the riser by swivelling chain fasteners.

5. A riser as claimed in claim 3, wherein the chains are attached to the riser by a connector mounted on a slewing ring rotatably held on the top section of the riser.

6. A riser as claimed in claim 1, wherein said at least one conduit comprises at least one pipe attached to the riser column on the exterior thereof at least in the region of the lower section of the column.

7. A riser as claimed in claim 6, wherein at least one flexible hose connects said at least one pipe to a production outlet in the vicinity of the base of the riser.

8. A riser as claimed in claim 1, wherein the base of the riser is adapted to be mounted above a sea-bottom drilling template.

9. A riser as claimed in claim 1, wherein a riser top manifold is provided at the top of the riser to permit said at least one fluid conduit to be connected to a vessel, rig, platform, and the like.

10. A riser as claimed in claim 1, wherein the riser is connected by four chains to a semi-submersible production platform.

11. A riser as claimed in claim 10, wherein the overall buoyancy of the riser with the chains attached thereto can be adjusted to neutral.

12. A riser as claimed in claim 10 or 11, wherein means is provided to enable the chains to be released quickly from the riser.

13. A riser as claimed in claim 1, wherein the flexible joint between the base and the riser column is a universal joint, a ball joint or a flex joint.

14. A self-standing marine riser comprising a base adapted to be mounted above a sea bottom drilling template, a riser column, a flexible joint between the base and the riser column, a plurality of chains attached to the top of the riser column for providing a loose coupling between the top of the riser column and a vessel, rig, platform and the like on the surface above the location of the riser, said riser column comprising a lower relatively slender column section and an upper column section including at least one variable buoyancy chamber, said buoyancy chamber being adapted to provide neutral buoyancy for the riser, sad riser supporting at least one conduit for the conveyance of a fluid, said chains being attached to a plate which carries a plurality of sockets positioned and shaped to mate with the corresponding number of posts formed on the top of the upper column section of the riser column to facilitate quick release of the chains from the riser.

* * * * *